US007255142B2

(12) United States Patent
Carder, Sr. et al.

(10) Patent No.: US 7,255,142 B2
(45) Date of Patent: Aug. 14, 2007

(54) FUEL NOZZLE GUARD

(75) Inventors: Mervin L. Carder, Sr., Fenton, MO (US); Mervin L. Carder, Jr., Manchester, MO (US); E. Leonard Poli, High Ridge, MO (US)

(73) Assignee: M. Carder Industries, Inc., Fenton, MO (US)

( * ) Notice: Subject to any disclaimer, the term of this patent is extended or adjusted under 35 U.S.C. 154(b) by 170 days.

(21) Appl. No.: 11/013,283

(22) Filed: Dec. 15, 2004

(65) Prior Publication Data

US 2005/0133113 A1 Jun. 23, 2005

Related U.S. Application Data

(60) Provisional application No. 60/531,049, filed on Dec. 19, 2003.

(51) Int. Cl.
*B65B 1/04* (2006.01)

(52) U.S. Cl. ..... 141/392; 40/299.01

(58) Field of Classification Search ..... 141/392, 141/206–219, 59; 239/103, 104; 40/299.01, 40/661, 790, 781

See application file for complete search history.

(56) References Cited

U.S. PATENT DOCUMENTS

| | | | | |
|---|---|---|---|---|
| 2,800,931 | A * | 7/1957 | Sutcliffe | 141/392 |
| 3,474,837 | A | 10/1969 | Carder et al. | |
| 4,418,730 | A * | 12/1983 | McMath | 141/207 |
| 4,465,209 | A | 8/1984 | Wilder | |
| RE31,882 | E * | 5/1985 | Moskovich | 141/5 |
| 4,668,318 | A | 5/1987 | Piccoli et al. | |
| 5,058,637 | A | 10/1991 | Fell | |
| 5,102,012 | A | 4/1992 | Foster | |
| 5,184,655 | A | 2/1993 | Fell | |
| 5,186,357 | A | 2/1993 | Foster | |
| 5,267,670 | A | 12/1993 | Foster | |
| D358,452 | S | 5/1995 | Karrick | |
| 5,458,170 | A | 10/1995 | Ferguson | |
| 5,603,364 | A | 2/1997 | Kerssies | |
| 5,806,217 | A | 9/1998 | Alvern | |
| 5,864,975 | A | 2/1999 | Alvern | |
| 6,192,609 | B1 | 2/2001 | Alvern | |
| 6,202,332 | B1 * | 3/2001 | Alvern | 40/299.01 |
| 6,237,262 | B1 | 5/2001 | Alvern | |
| 6,283,320 | B1 | 9/2001 | Patch | |
| 6,401,767 | B1 | 6/2002 | Cohen et al. | |

(Continued)

OTHER PUBLICATIONS

ACL Incorporated, Staticide Polystat 500, Nov. 11, 2002.

(Continued)

*Primary Examiner*—Steven O. Douglas
(74) *Attorney, Agent, or Firm*—Polster, Lieder, Woodruff & Lucchesi, L.C.

(57) ABSTRACT

A fuel nozzle guard, in some embodiments, comprises a static control material. When a consumer grabs the fuel nozzle, his or her hand will touch the static control material, thereby, safely dissipating any electrostatic charges at a controlled rate of discharge without a spark. The fuel nozzle guard, in some embodiments, slides onto the nozzle interfacing with the nozzle so that retaining edges secure the fuel nozzle guard to the nozzle, without removing the nozzle from its hose. The material, in some embodiments, lacks plastisol and allows labels to adhere directly to it.

18 Claims, 4 Drawing Sheets

U.S. PATENT DOCUMENTS

| | | | |
|---|---|---|---|
| 6,575,206 | B2 | 6/2003 | Struthers et al. |
| 6,592,955 | B1 | 7/2003 | Dupont et al. |
| 6,604,551 | B2 | 8/2003 | Nishi et al. |

OTHER PUBLICATIONS

ACL Staticide, ACL Polystat 500 Technical Properties Data, undated.

Kelly, M.A. et al., An Investigation of Human Body Electrostatic Discharge, The 19th International Symposium for Testing & Failure Analysis, 1993.

LNP Engineering Plastics, Inc., Stat-Kon, Bulletin No. 223-5.01-2.5, 2001.

Penno, Stefan, MD, Eliminating Electrostatics, Kersting Industrieausrüstungen GmbH, undated.

Pidoll, Ulrich von, Electrostatic ignition hazards in motor cars—occurrence, detection and avoidance (2003).

Rohm and Haas Italia S.r.l., Spark-Lite Dissipative Powder Coatings, undated.

5 Tau, LLC, Static Electricity & Refueling Fire Safety, undated.

* cited by examiner

FUEL NOZZLE GUARD

CROSS-REFERENCE TO RELATED APPLICATIONS

This application is related to U.S. Provisional Patent Application No. 60/531,049, filed Dec. 19, 2003, from which priority is claimed, and the disclosure of which is hereby incorporated by reference.

BACKGROUND OF THE INVENTION

This invention relates to devices used with fuel nozzles. In the field of commercial gasoline stations, there is an increased awareness of the dangers of electrostatic discharge around fuel pumps. Electrostatic Discharge (ESD) is often defined as a transfer of electrostatic charge between bodies at different electrostatic potentials caused by direct contact or induced by an electrostatic field. For purposes of this application, ESD refers to a rapid transfer of an electrostatic charge, resulting in a spark sufficient to ignite combustible gases. When ESD occurs around a fuel pump, it can ignite the gasoline vapors and start a fire. These fires may, for example, be caused by a person re-entering his or her vehicle during refueling to get warm, or by containers not being filled on the ground. As a result, different devices and methods have been developed to try to safely discharge static charges around fuel pumps.

One method of solving the problem of ESD near a fuel dispensing apparatus places static dissipative signs near the pump for consumers. These signs require the consumer to purposely approach and touch the sign to safely discharge any static charges he or she is carrying. However, if the consumer fails to notice or use the sign, the risk of ESD occurring and starting a fire is still present. It is now common to require that a fuel hose connected to the fuel nozzle be grounded. In theory, static charges are safely dissipated through the hose when the consumer contacts the nozzle or fuel hose, before fueling begins. However, in practice the nozzle and fuel hose are typically covered with insulating materials that may prevent safe discharge of the user, and in any event the consumer may take actions, like re-entering the vehicle, which change his or her electrostatic potential after fueling has begun. Unless the user has previously been grounded, contact by the user with the fuel nozzle or other objects may cause a dangerous spark by ESD.

It is common practice to equip fuel dispensing nozzles with a guard, which is generally a close-fitting elastomeric jacket or cover that is pulled over the nozzle to provide a comfortable handgrip for the nozzle user, and to provide a bumper surface to keep from nicking the finish of vehicles with the nozzle as gasoline is dispensed. The guard is usually formed of a soft plastic material such as vinyl, which may be easily injection molded, or dip molded using a formed mandrel plunged into a vinyl plastisol, wherein the vinyl guard may be then stripped from the mandrel for use on the nozzle. The vinyl compounds used for guards are fairly impervious to gasoline and other contaminants encountered in the field, and may be replaced when damaged.

However, there are some disadvantages to this type of guard. The vinyl compounds can prevent safe static discharge through a grounded nozzle or hose, generally not because they are inherently Insulative, but because they are so thin that they do not prevent sparking between a user and the nozzle. In addition, it is cumbersome to replace the guard because, typically, the nozzle must be disconnected from the fuel pump hose before removal and replacement of the guard. Another disadvantage is that adhesive labels used for information and advertising do not readily adhere to vinyl plastisols. As a result, recent trends to include advertising on nozzles require installation of a second display cover on top of the guard. While the second display covers provide an effective surface for advertising and information, they are usually large, bulky, and comprise multiple parts which complicate installation and replacement of ads.

BRIEF SUMMARY OF THE INVENTION

Briefly stated, in accordance with one embodiment of the present invention, a fuel nozzle guard is provided comprising a static control material that safely dissipates static charges at a controlled rate of discharge and reduces or eliminates ESD.

In accordance with another embodiment, a fuel nozzle guard is provided comprising a unitary guard having a handle portion and a body portion shaped to conform to a fuel nozzle, and retaining edges that secure the guard to the fuel nozzle.

In accordance with another embodiment of the invention, a fuel nozzle guard is made of a material to which labels may be directly adhered, the guard comprising a display surface, preferably recessed, for information and advertising.

In accordance with another embodiment, a fuel nozzle guard is provided comprising a unitary guard member having a handle portion and a body portion shaped to conform to a fuel nozzle, the handle portion and body portion being formed of a self-supporting resilient material, the guard member being formed to be snapped onto a fuel nozzle while the nozzle is attached to a fuel hose. The material is preferably a rigid plastic such as polypropylene.

In another embodiment, a method of protecting a facility having a dispensing nozzle attached to a source of volatile, flammable fluid from fire or explosion caused by electrostatic discharge is provided, the method comprising connecting the nozzle to an electrical ground and providing a static control material on a portion of the nozzle apt to be touched by a user of the nozzle, so as to safely discharge any electrostatic charge at a controlled rate. The static control material is positioned so that it is the first non-insulative part touched by the user.

In the illustrative embodiments of the invention, the static control material is a static dissipative material with a surface resistivity of about $10^7$ to $10^8$ ohm/sq. When contacted, this allows electrostatic charges to dissipate at a safe, controlled rate of discharge. For the purposes of this application, a static control material is a material which exhibits a static control property, including static dissipative, static shielding, anti-static, or combination thereof. A static dissipative material is defined as a material that allows electrostatic charges to flow to ground more slowly and in a somewhat more controlled manner than a conductive material. As is known in the art of ESD, it is desirable for a static dissipative material to have a surface resistivity of about $10^5$ to $10^{12}$ ohm/sq, preferably $10^6$ to $10^{10}$ ohm/sq, while a conductive material has a surface resistivity of about less than $10^5$ ohm/sq. For the purposes of this application, surface resistivity is the measure of a surface's resistance to the flow of electricity, usually expressed in ohm/sq.

The preferred embodiments of the static dissipative material for use in the present invention are inherently dissipative plastics, such as those sold under the mark Staticide Polystat 500, sold by ACL Incorporated, Elk Grove Village, Ill. These materials have the advantage over filled plastics (such as carbon-filled plastics) that they are not dependent on humidity for their effectiveness, that they are uniformly dissipative, and that their properties are permanent.

Those skilled in the art will recognize that other static dissipative materials may be used in the present invention, such as, by way of example, the semi-conductive polyethylene called ICORENE™ as disclosed in U.S. Pat. No. 6,283,320, hereby incorporated by reference, Starex permanent antistatic ABS from Cheil Industries, Korea, or carbon-filled plastics.

While the static control material in the illustrative and preferred embodiments is a static dissipative material, in accordance with some embodiments it may also be an anti-static material, a static shielding material, or combinations thereof. For the purposes of this application, an anti-static material is defined as a material which reduces the amount of electrostatic charge generated by tribocharging. Anti-static materials are also referred to as low-charging. Tribocharging is electrostatic charging that occurs upon contact or frictional conduct of materials. For the purposes of this application, an electrostatic shielding material is a material with a conductive layer with a surface resistivity of less than $10^4$. For the purposes of this application, an insulative material is a material that prevents or limits the flow of electrons across its surface with a surface resistivity of at least about $10^{12}$.

BRIEF DESCRIPTION OF THE SEVERAL VIEWS OF THE DRAWINGS

In the accompanying drawings which form part of the specification.

Corresponding reference numerals indicate corresponding parts throughout the several figures of the drawings.

DETAILED DESCRIPTION

The following detailed description illustrates the invention by way of example and not by way of limitation. The description clearly enables one skilled in the art to make and use the invention, describes several embodiments, adaptations, variations, alternatives, and uses of the invention, including what is presently believed to be the best mode of carrying out the invention.

Figure 1:
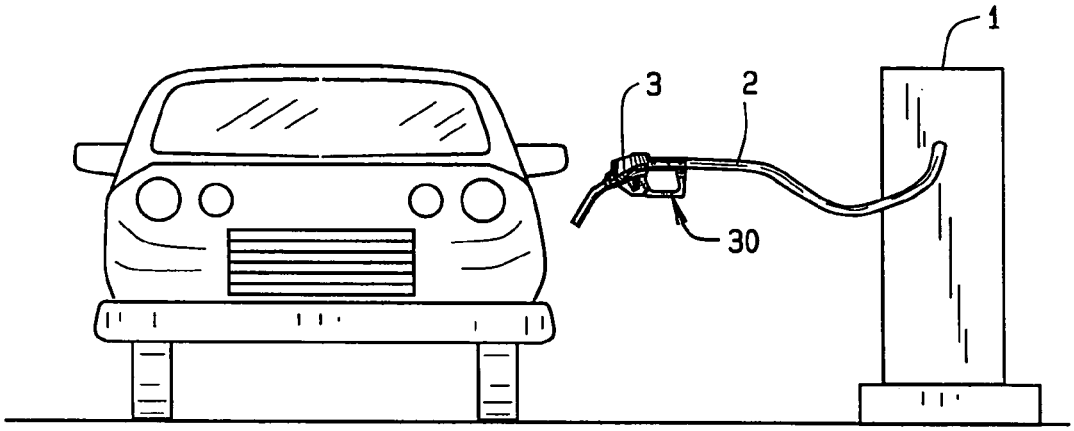
FIG. 1 is a schematic view of fuel dispensing system incorporating a fuel nozzle.
Figure 2:
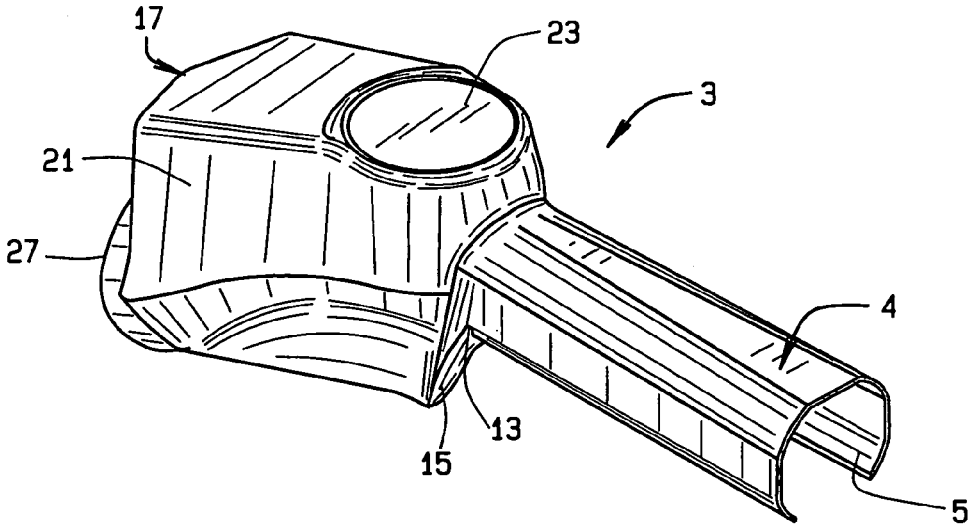
FIG. 2 is a top perspective view of an embodiment of a fuel nozzle guard suitable for use on the nozzle of FIG. 1.
Figure 3:
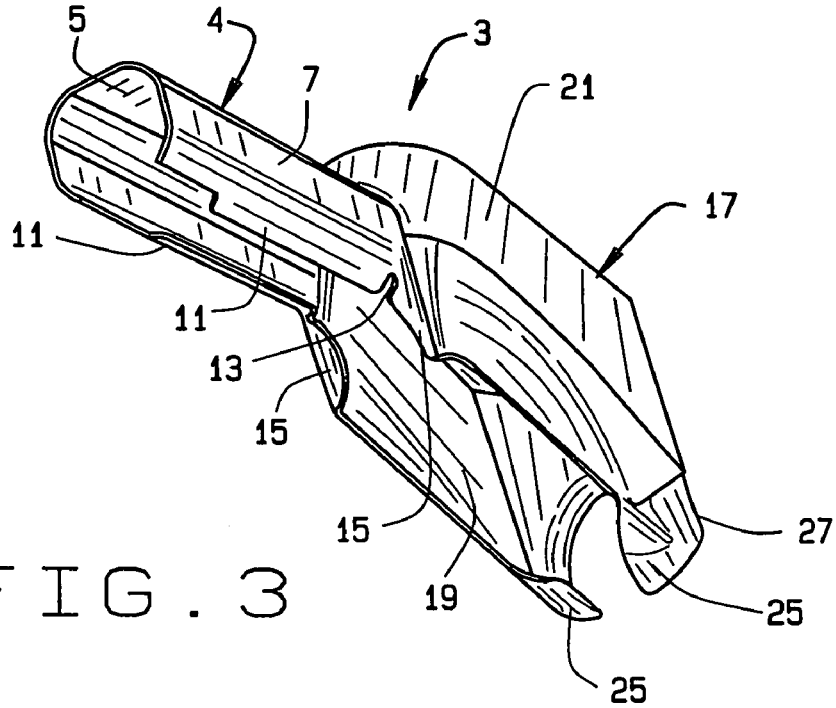
FIG. 3 is a bottom perspective view of the embodiment of the fuel nozzle guard.
Figure 4:
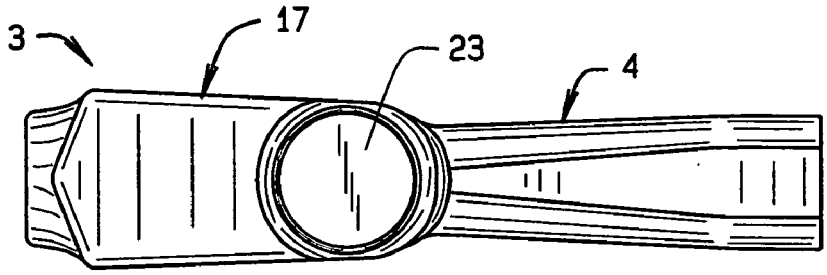
FIG. 4 is a top view of the embodiment of the fuel nozzle guard.
Figure 5:
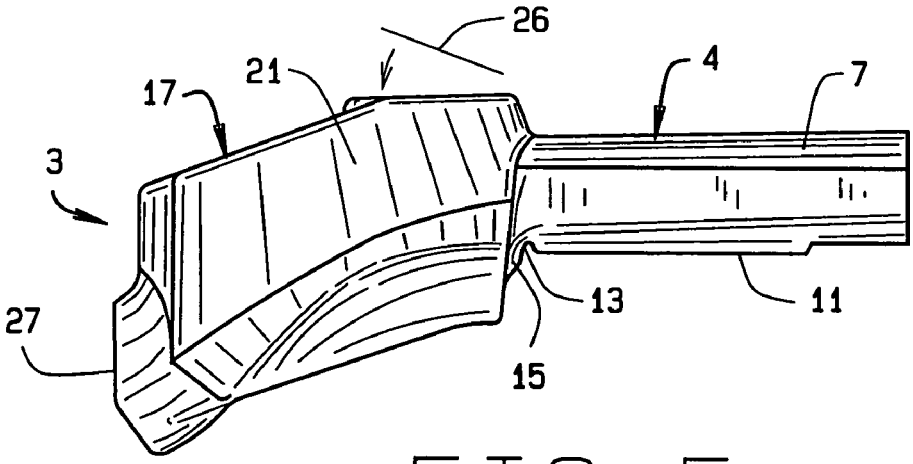
FIG. 5 is a side view of the embodiment of the fuel nozzle guard.
Figure 6:
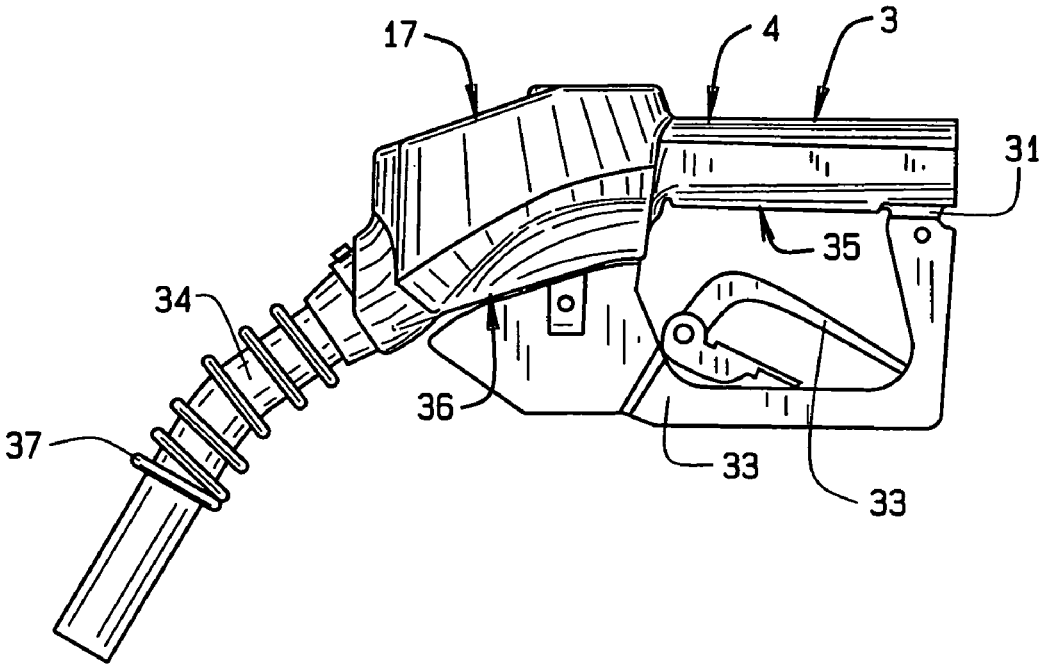
FIG. 6 is a side view of the embodiment of the fuel nozzle guard installed on the fuel nozzle.

As shown in FIG. 1, a fuel pump system includes a fuel pump 1 operatively connected to a fuel hose 2 for communicating fuel to a fuel dispensing nozzle 30. Conventionally, the hose 2 includes an electrical conductor which electrically grounds the nozzle 30 through the pump 1. The fuel nozzle 30 is covered by one embodiment of a static control fuel nozzle guard 3 of the present invention. The nozzle guard 3 is formed of a static control material and is electrically connected to ground through the fuel nozzle 30 and the fuel hose 2 so that electrostatic charges are safely dissipated through the guard 3 and hose 2 to the ground when the consumer contacts the guard 3 or hose 2.

The illustrative static control fuel nozzle guard 3 described herein is adapted to fit an OPW Model 11A gasoline-dispensing nozzle. This nozzle is popular commercially and is widely described in the literature. A version of it is shown, for example in U.S. Pat. No. 5,603,364, incorporated by reference herein. It will be understood that guards in accordance with the invention may be made to fit any dispensing nozzle.

As is well-known in the art, most fuel dispensing nozzles 30 include a body 31, usually cast of aluminum or the like, a lever guard 32, usually cast as a separate piece, a manually operable lever 33, and a spout 34. The body 31 conventionally includes a handgrip 35 and a forward valve body 36 which contains a manually activated valve and an automatic shutoff system, not shown. The lever 33 is conventionally pivoted to the shut-off mechanism for operating the main valve when the lever 33 is raised. A portion of the spout 34 is typically surrounded by a coil spring 37 which impedes the nozzle 30 from accidental disengagement from a tank filler neck. The lever 33 and lever guard 32 may be made of metal or plastic. The spout 34 and spring 37 are typically metal.

As shown in FIGS. 1-6 a first embodiment of a static control fuel nozzle guard 3 comprises a handle portion 4 and a body portion 17. The handle portion 4 is a penannular cylinder, having an inside surface 5 for interfacing with the handgrip 35 of the fuel nozzle 30, an outside surface 21, first retaining edges 11 for securing to the handgrip 35, and notches 13 that provide flexibility and stress-relief to the handle portion 4.

The body portion 17 defines an inner surface 19 for interfacing with the valve body 36 of the fuel nozzle 30, second retaining edges 15 for securing to the valve body 36, third retaining edges 25 for securing to the valve body 36, and a display surface 23 for receiving adherent labels 26. Both the inside surface 5 of the handle portion 4 and inside surface 19 of the body portion 17 are shaped to conform to the fuel nozzle 30 sufficiently to provide a tight fit. The fit should be tight enough to prevent slippage, but yet loose enough to allow for easy installation.

The entire guard 3 is formed of a static control material, preferably a dissipative plastic material. The material is preferably an inherently dissipative polypropylene material having a static decay period of less than two seconds. In practice, these materials will reduce the difference in potential between the guard and a person touching it to a safe level in a fraction of a second. An illustrative embodiment of such a material is a rigid polypropylene material incorporating Staticide Polystat 500, an inherently dissipative plastic sold by ACL Incorporated, Elk Grove Village, Ill. This material has a surface resistivity of about $10^9$ ohm per square.

The fuel nozzle guard 3 is easily installed on a fuel nozzle 30 without removing the nozzle 30 from its hose 2. To install, the fuel nozzle guard 3 slides from the top onto the fuel nozzle 30 until the inner surface 5 of the handle portion 4 interfaces with the handgrip 35 and the inner surface 19 of the body portion 17 interfaces with the valve body 36. As the fuel nozzle guard 3 slides onto the fuel nozzle 30, the notches 13 allow the handle portion 4 and body portion 17 to stretch over the handgrip 35 and valve body 36 without cracking. When completely installed, first retaining edges 11, second retaining edges 15, and third retaining edges 25 snap over the fuel nozzle 30 and secure the fuel nozzle guard 3 to the fuel nozzle 30 with the retaining edges 11, 15, and 25, and the inside surfaces 5 and 19 making good electrical contact with the nozzle 30. In this position, the guard 3 will be the first surface a user will touch when grabbing the nozzle 30, thereby safely dissipating any static charges carried by the user at a controlled rate of discharge. If desired, either or both of the lever guard 32 and the lever 33 may be formed of, or covered with, an insulative or a static control material.

The nozzle guard 3 resists accidental removal, but may be deliberately removed by prying the guard upward from the handgrip and rocking it forward to disattach it.

Information and advertising labels 26 can be placed on the display surface 23. Standard peel-off or permanent adhesives will hold the round labels, sized to fit the recessed display surface 23, without the need for a special cover piece to hold them. Additional labels 26 may be adhered directly to the first label, or the first label may be peeled off the surface 23 before a new label is applied.

Figure 7:
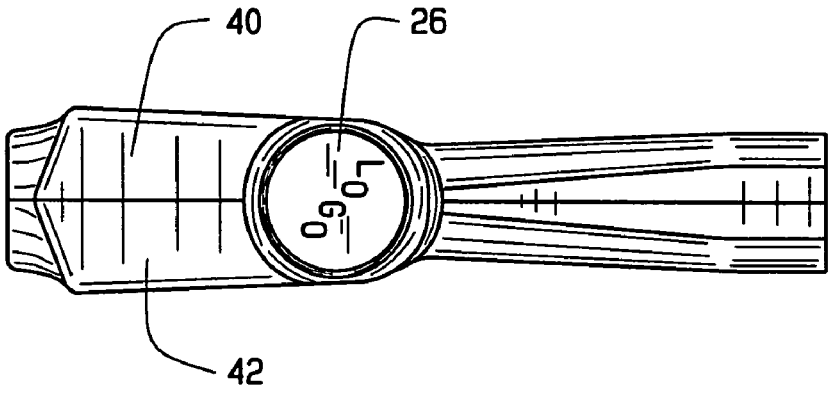
FIG. 7 is a top view of a second embodiment of the fuel nozzle guard.
Figure 8:
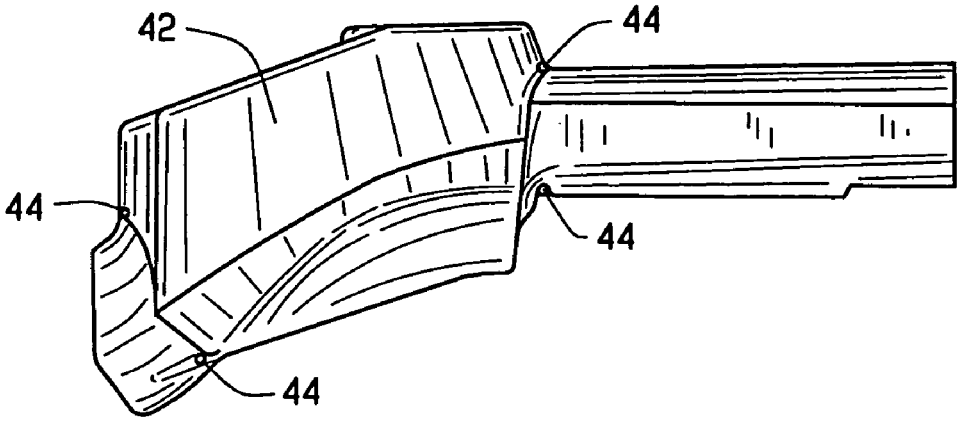
FIG. 8 is a side view of the fuel nozzle guard of FIG. 7.

Although the embodiments shown in FIGS. 1-6 disclose a unitary fuel nozzle guard 3, it may also embody multiple parts. For example in FIGS. 7 and 8, the fuel nozzle guard 3 may comprise two or more pieces, such as a left half 40 and a right half 42 or a front half and back half which mate by snapping together or securing with any appropriate securing device 44, such as screws. When multiple parts are used, the fuel nozzle guard 3 may encompass the entire spout 34. In this embodiment, there is no opening at the bottom of the fuel nozzle guard 3, and no retaining edges 11, 15, and 25 are needed.

Figure 9:
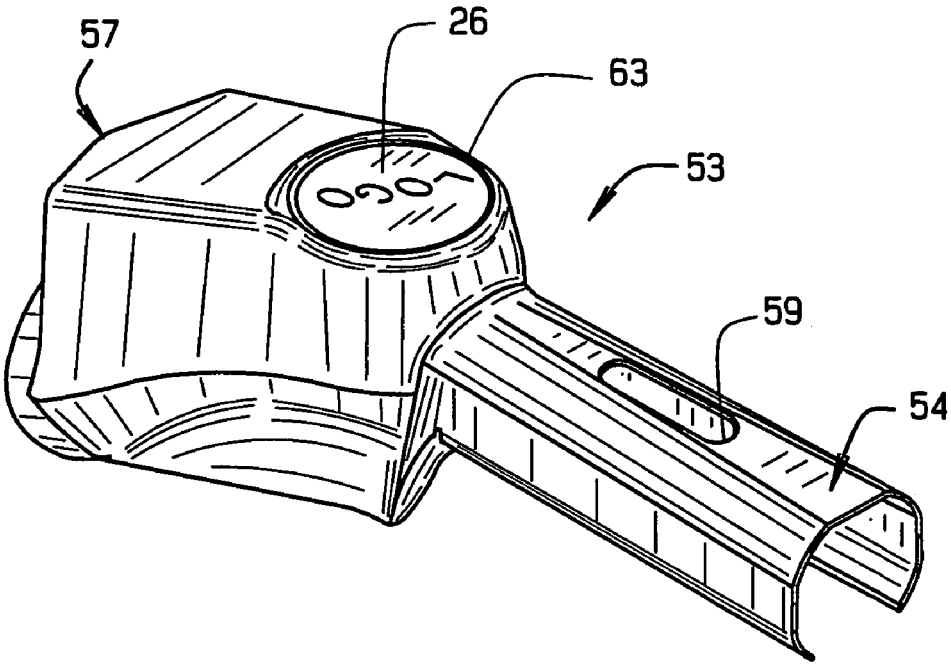
FIG. 9 is a view in perspective, corresponding to FIG. 2, of a third embodiment of fuel nozzle guard.

The static control portion of the invention need not be the entire nozzle guard. As shown in FIG. 9 a third embodiment of a static control fuel nozzle guard 53 comprises a handle portion 54 and body portion 57 which are generally identical in shape to those of the first embodiment. This embodiment differs from the first embodiment in that the guard 53 is made of an insulative material which resists sparking through it and includes a discrete static control member 59. The handle portion 54 has an obround opening for hosting the obround static control member 59. When the guard 53 is positioned on it, the static control member 59 contacts the metal body 31 of the nozzle 30, which in turn is electrically connected to ground, such as through a ground wire in the fuel pump hose 2. The static control member 59 is made from a static dissipative material, such as a carbon-filled polymer formulated to prevent sparking in its intended environment. The static control member 59 is located on the top of the handgrip 35. Therefore, when a user grabs the fuel nozzle 30 his or her hand will touch the static control member 59, thereby safely dissipating any static charges at a controlled rate of discharge. In the preferred form of this embodiment, the guard 53 is made of a plastic material which allows label 26 to adhere directly to recessed area 63.

Although the embodiment shown in FIG. 9 illustrates a static control member 59 that is an obround pad, other embodiments of different size, shape, and location may be used. For example, the static control member 59 may embody a ring, band, or stud located on the handle portion or the body portion. In another example, the static control member can embody the lever 33, the coil spring 37, or other device attached to the fuel nozzle 30. In a vapor recovery fuel nozzle, the static control member can embody the bellows. Also, it may embody a splashguard, such as the splashguard disclosed in U.S. Pat. No. D287,996 issued to Carder Sr., hereby incorporated by reference. The static control member may also be used with other types of guard, such as dip vinyl, molded vinyl, injection molded, or molded vinyl or nylon guards, so long as the guards are sufficiently Insulative in use to prevent sparking. In addition, the body of the guard 3 in the first and second embodiments, or the static control member 59 in the third embodiment may be made from any of a multitude of static control materials as described above. Some of the advantages of the present invention may be obtained by applying a static-control surface directly to the nozzle 30, as by flame spraying a dissipative coating on the nozzle itself.

In addition, the fuel nozzle guard 3 may be made from a multitude of different materials, such as ABS, polyethylene, or nylon. If desired, the fuel nozzle guard 3 may have special coloring, such as fluorescent or glow-in-the dark. The fuel nozzle guard 3 may also incorporate other static control properties or materials.

Although the embodiments shown in FIGS. 1-9 disclose the adhesive labels on the display surface 23, other methods and types of information and advertising may be used, such as branding.

As various other changes could be made in the above constructions without departing from the scope of the invention, it is intended that all matter contained in the above description or shown in the accompanying drawings shall be interpreted as illustrative and not in a limiting sense.

The invention claimed is:

1. A fuel nozzle guard comprising:

a unitary guard member having a handle portion and a body portion shaped to conform to a fuel nozzle, retaining edges that secure the guard to the fuel nozzle in a snap-fit manner, and stress notches sized to provide flexibility and stress-relief between the handle portion and the body portion.

2. A fuel nozzle guard as in claim 1 further comprising a display surface for information and advertising.

3. A fuel nozzle guard as in claim 1 further comprising a static control material associated with the handle portion of the unitary guard member and electrically connected to a ground.

4. A fuel nozzle guard as in claim 3 wherein the static control material is selected from the group consisting of static dissipative, anti-static, static shielding, and combinations thereof.

5. A fuel nozzle guard as in claim 4 wherein the static control material comprises a static dissipative material with a surface resistivity between about $10^5$ and $10^{12}$.

6. A fuel nozzle guard comprising:

a guard shaped to conform to a fuel nozzle, the guard being a unitary construction comprising a handle portion and a body portion shaped to conform to a fuel nozzle, retaining edges that secure the guard to the fuel nozzle in a snap-fit manner, and stress notches sized to provide flexibility and stress-relief between the handle portion and the body portion; and a static control material associated with at least a part of the guard.

7. A fuel nozzle guard as in claim 6 wherein the static control material is selected from the group consisting of static dissipative, anti-static, static shielding, and combinations thereof.

8. A fuel nozzle guard as in claim 6 wherein the static control material comprises a static dissipative material with a surface resistivity between $10^5$ and $10^{12}$.

9. A fuel nozzle guard as in claim 6 wherein the guard is formed from the static dissipative material.

10. A fuel nozzle guard comprising a unitary guard member having a handle portion shaped to conform to a handgrip of a fuel nozzle and a body portion shaped to conform to a forward valve body of a fuel nozzle, the handle portion and body portion being formed of a self-supporting, rigid, resilient material, the guard member being formed to be snapped onto a fuel nozzle while the nozzle is attached to a fuel hose, the handle portion snapping onto the handgrip and the body portion snapping onto the forward valve body.

11. A fuel nozzle guard as in claim 10 further comprising a depressed area sized for receipt of adhesive labels, the self-supporting resilient material being substantially free of plastisol.

12. A fuel nozzle guard as in claim 10 further comprising stress notches sized to provide flexibility and stress-relief between the handle portion and the body portion.

13. A fuel nozzle guard as in claim 10 wherein at least a portion of the guard is made of a static control material selected from the group consisting of static dissipative, anti-static, static shielding, and combinations thereof.

14. A fuel nozzle guard as in claim 13 wherein the material comprises a static dissipative material with a surface resistivity between $10^5$ to $10^{12}$.

15. A fuel nozzle guard as in claim 14 wherein the static dissipative material has a surface resistivity between about $10^6$ and $10^{10}$.

16. A method of protecting a fuel nozzle with a plastic guard, the method comprising forming a guard member having a handle portion shaped to conform to a handgrip of a fuel nozzle and a body portion shaped to conform to a forward valve body of a fuel nozzle, the handle portion and body portion being formed of a self-supporting, rigid, resilient material, the guard member being formed to be snapped onto a fuel nozzle while the nozzle is attached to a fuel hose, and thereafter snapping the handle portion onto the handgrip and the body portion onto the forward valve body.

17. The method of claim 16 comprising providing first retaining edges on the handle portion and causing the retaining edges to engage the handgrip.

18. The method of claim 17 comprising providing at least second retaining edges on the body portion and causing the retaining edges to engage the forward valve body.

* * * * *